US006846222B2

(12) United States Patent
Church et al.

(10) Patent No.: US 6,846,222 B2
(45) Date of Patent: Jan. 25, 2005

(54) MULTI-CHAMBERED, COMPLIANT APPARATUS FOR RESTRAINING WORKPIECE AND APPLYING VARIABLE PRESSURE THERETO DURING LAPPING TO IMPROVE FLATNESS CHARACTERISTICS OF WORKPIECE

(75) Inventors: Mark A. Church, Los Gatos, CA (US); Alain M. L. Desouches, Santa Cruz, CA (US); Glenn P. Gee, San Jose, CA (US)

(73) Assignee: Hitachi Global Storage Technologies Netherlands, B.V. (NL)

( * ) Notice: Subject to any disclaimer, the term of this patent is extended or adjusted under 35 U.S.C. 154(b) by 84 days.

(21) Appl. No.: 10/379,497

(22) Filed: Mar. 4, 2003

(65) Prior Publication Data

US 2004/0176013 A1 Sep. 9, 2004

(51) Int. Cl.[7] ..... B24B 49/00; B24B 51/00

(52) U.S. Cl. ..... 451/5; 451/8; 451/41; 451/364

(58) Field of Search ..... 269/20, 22, 24; 451/364, 1, 5, 8, 9, 10, 11, 41, 42, 59, 259, 296, 365

(56) References Cited

U.S. PATENT DOCUMENTS

| | | | | |
|---|---|---|---|---|
| 4,606,151 A | * | 8/1986 | Heynacher | 451/42 |
| 4,918,869 A | | 4/1990 | Kitta | |
| 5,203,119 A | | 4/1993 | Cole | |
| 5,205,082 A | | 4/1993 | Shendon et al. | |
| 5,468,177 A | | 11/1995 | Kindler et al. | |
| 5,525,091 A | | 6/1996 | Lam et al. | |
| 5,584,751 A | | 12/1996 | Kobayashi et al. | |
| 5,607,340 A | | 3/1997 | Lackey et al. | |
| 5,635,083 A | | 6/1997 | Breivogel et al. | |
| 5,762,544 A | | 6/1998 | Zuniga et al. | |
| 5,913,719 A | | 6/1999 | Hasegawa et al. | |
| 5,951,371 A | | 9/1999 | Hao | |
| 5,980,361 A | | 11/1999 | Mueller et al. | |
| 6,093,089 A | | 7/2000 | Chen et al. | |
| 6,110,017 A | * | 8/2000 | Savoie et al. | 451/42 |
| 6,120,360 A | | 9/2000 | Ball et al. | |
| 6,123,608 A | | 9/2000 | Nakagawa et al. | |
| 6,135,858 A | | 10/2000 | Takahashi | |
| 6,163,954 A | | 12/2000 | Nakagawa | |
| 6,203,408 B1 | | 3/2001 | Quek | |
| 6,225,224 B1 | | 5/2001 | Pandey et al. | |
| 2001/0051491 A1 | | 12/2001 | Hao et al. | |
| 2002/0016130 A1 | | 2/2002 | Nomura et al. | |

FOREIGN PATENT DOCUMENTS

| | | |
|---|---|---|
| JP | 403263604 A | 11/1991 |
| JP | 403-263604 A | 11/1991 |
| JP | 812916 A | 10/1994 |
| JP | 8129716 A | 5/1996 |
| JP | 2003-220568 | 8/2003 |
| JP | 2003-266325 | 9/2003 |

* cited by examiner

*Primary Examiner*—Timothy V. Eley
(74) *Attorney, Agent, or Firm*—Bracewell & Patterson, LLP

(57) ABSTRACT

An apparatus and method of lapping of rows of magnetic recording heads uses multiple fluid-filled ports with variable pressure against a flexible adhesive tape to secure to and support the row. The tape provides the necessary tangential restraining force to drag the workpiece along a lapping plate. The multiple ports beneath the tape provide the necessary normal force to press the workpiece against the lapping plate to allow lapping to occur. The amount of material removal from the row is varied by adjusting the pressure in the ports such that higher pressure is applied to those heads with higher stripe height, and lower pressure is applied to recording heads with lower stripe height. To set or adjust the port pressures, measurements of the read sensor resistance are taken to calculate the stripe height. The stripe height is roughly proportional to the reciprocal of resistance.

17 Claims, 10 Drawing Sheets

MULTI-CHAMBERED, COMPLIANT APPARATUS FOR RESTRAINING WORKPIECE AND APPLYING VARIABLE PRESSURE THERETO DURING LAPPING TO IMPROVE FLATNESS CHARACTERISTICS OF WORKPIECE

BACKGROUND OF THE INVENTION

1. Technical Field

The present invention relates in general to a fixture for restraining workpieces during fabrication and, in particular, to improving the flatness control of a workpiece during a lapping process. Still more particularly, the present invention relates to a compliant apparatus for restraining a workpiece having improved kinematics for flatness and electrical resistance feedback for better stripe height control.

2. Description of the Related Art

Data access and storage devices (DASDs) such as disk drives use magnetic recording heads to read data from or write data to the disks as they spin inside the drive. Each head has a polished air bearing surface (ABS) with flatness parameters, such as crown, camber, and twist. The ABS allows the head to "fly" above the surface of its respective spinning disk. In order to achieve the desired fly height, fly height variance, take-off speed, and other aerodynamic characteristics, the flatness parameters of the ABS need to be tightly controlled.

Although a number of processing steps are required to manufacture heads, the ABS flatness parameters are primarily determined during the final lapping process. The final lapping process may be performed on the heads after they have been separated or segmented into individual pieces, or on rows of heads prior to the segmentation step. This process requires the head or row to be restrained while an abrasive plate of specified curvature is rubbed against it. As the plate abrades the surface of the head, the abrasion process causes material removal on the head ABS and, in the optimum case, will cause the ABS to conform to the contour or curvature of the plate. The final lapping process also creates and defines the proper magnetic read sensor and write element material heights needed for magnetic recording.

There are a number of factors that affect the accuracy of ABS curvature during the final lapping process. These include diamond size/morphology, lubricant chemistry, lapping tangential surface velocity, plate material, lapping motion/path on the plate, and other lapping parameters. In addition to these parameters, three critical conditions must be satisfied. First, it is essential that the contour of the abrasive plate be tightly controlled since, in the best case, the ABS will conform to the curvature of the plate. In addition, all components of the process, including the head/row, must be restrained without distortion during lapping. Any variance in the restraining forces will cause the parts to distort and/or elastically deform upon removal of the forces. For example, if a head or row is lapped on an absolutely flat surface while it is clamped in a fixture, the part will elastically deform to a non-flat condition when it is released. The amount of deformation is proportional to the amount of elastic distortion created when the part was initially clamped.

A third condition affecting the accuracy of the ABS is the lapping force, which is the amount of force exerted by the abrasive plate on the part being lapped. Ideally, the lapping force is minimized to reduce distortion during the lapping process. The holding fixture exerts forces which are normal to the plate for pushing the part against the plate, and tangential to the plate for causing the part to slide over the plate for material removal. Unfortunately, this combination of forces elastically distorts the part (e.g., the head).

For example, to lap a flat surface on an initially curved ABS, the normal-directed force of the flat (and assumably non-deformable) plate against the curved ABS causes the ABS to temporarily flatten. The amount of deflection or flattening of the part will depend on the magnitude, direction, and distribution of the force on the part. Under sufficiently high normal-directed force, the entire surface area of the ABS is in contact with the plate. Introducing tangential movement of the part against an abrasive flat plate causes the entire surface area of the ABS to be abraded, not just the non-flat portions of the ABS. Upon removal of the normal-directed force, the ABS will elastically return to a non-flat condition. To minimize the amount of elastic return, it is desirable to provide a low but evenly distributed, normal-directed force on the part. The desired optimum low normal force will depend on a number of factors, such as diamond size/morphology, lubricant chemistry, lapping tangential velocity, and other lapping parameters. Thus, an improved apparatus and method for accurately defining the curvature of an ABS during the final lapping process is needed.

SUMMARY OF THE INVENTION

One embodiment of an apparatus and method of the present invention improves the lapping of rows of magnetic recording heads by providing excellent flatness characteristics, such as crown, camber, twist, recession, and protrusion, while also improving the read sensor stripe height range. The present invention provides a lapping structure that has improved kinematics for flatness and resistance feedback for better stripe height control.

The lapping system uses multiple fluid-filled chambers with variable pressure against a flexible membrane, such as tape, to support at least one workpiece. The workpiece is typically mounted to the membrane with adhesive and can freely gimbal. The tape allows free movement in a normal direction so that flatness parametrics are optimized, but provides the necessary tangential restraining force to drag the workpiece along a lapping plate. The multiple chambers beneath the tape provide the necessary normal force to press the workpiece against the lapping plate to allow lapping to occur.

It is desirable to be able to vary the amount or removal of material such that the final stripe height of the row of recording heads has a narrower range. The higher vertical forces result in greater lap rates, and this is accomplished by adjusting the pressure in the chambers such that higher pressure is applied to those heads with higher stripe height. Conversely, relatively lower pressure is applied to recording heads with lower stripe height. To set or adjust the pressures in the chambers, measurements of the read sensor resistance are taken to calculate the stripe height. These calculations are based on knowing the sensor width, thickness, and contact geometry. The stripe height is roughly proportional to the reciprocal of resistance. Increasing the number of chambers increases the degrees of freedom to which the system can vary the stripe height removal. The methods of adjusting the pressures in the chambers for variable amounts of stripe height removal can be either through sampled resistance measurement or in-situation sampled measurement of resistance.

The foregoing and other objects and advantages of the present invention will be apparent to those skilled in the art, in view of the following detailed description of the preferred embodiment of the present invention, taken in conjunction with the appended claims and the accompanying drawings.

BRIEF DESCRIPTION OF THE DRAWINGS

So that the manner in which the features and advantages of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only an embodiment of the invention and therefore are not to be considered limiting of its scope as the invention may admit to other equally effective embodiments.

DETAILED DESCRIPTION OF A PREFERRED EMBODIMENT

Figure 1:
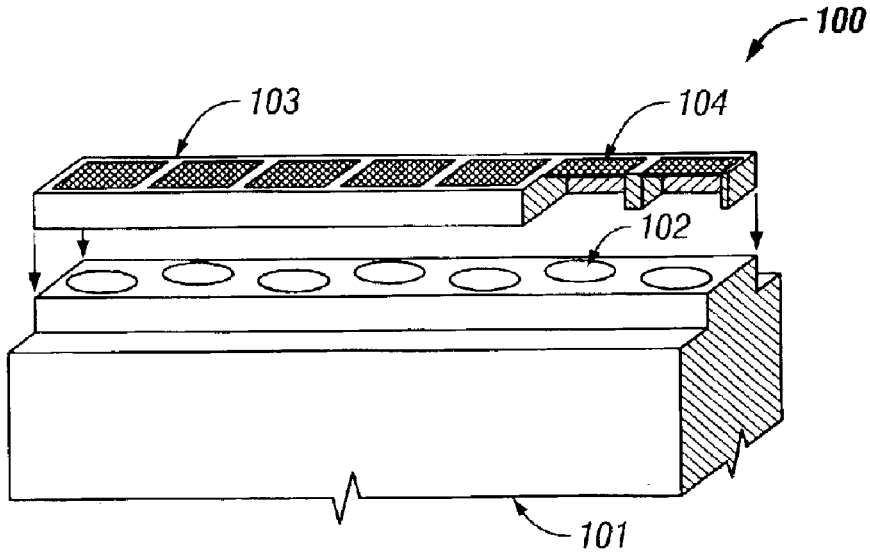
FIG. 1 is an exploded isometric view of a portion of one embodiment of a lapping fixture constructed in accordance with the present invention, and is shown at an initial stage of assembly.
Figure 2:
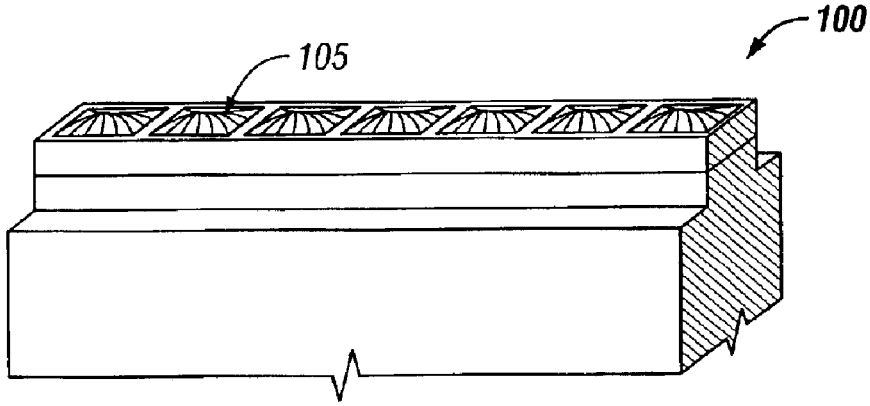
FIG. 2 is an isometric view of the lapping fixture of FIG. 1 and is shown with its membranes inflated.

Referring to FIG. 1, one embodiment of a lapping fixture 100 constructed in accordance with the present invention is shown. Lapping fixture 100 is inverted from its position for normal operation to reveal details of the invention. Lapping fixture 100 comprises a rigid base 101 that is formed from a material such as aluminum. Base 101 has a plurality of individual ports 102 which extend therethrough to form, in the embodiment shown, a single row array. An air bank fixture 103 having a plurality of respective air cells, including flexible membranes 104, is joined to base 101 over ports 102. Fixture 103 and membranes 104 are preferably formed or molded from the same elastic material, such as molded polyurethane, and are adhesively bonded to fixture 101 such that ports 102 are sealed at one end. The air cells in fixture 103 have thick wall sections in all walls except pressure membranes 104. The thin membranes 104 allow the air pressure through ports 102 to be directed to and displace the cell membranes 104 rather than the other wall sections of fixture 103, which have thicker sectional areas. FIG. 2 illustrates the lapping fixture 100 with individual air pressure activation in each port 102 causing respective ones of the membranes 104 to expand into a bubble 105.

Figure 3:
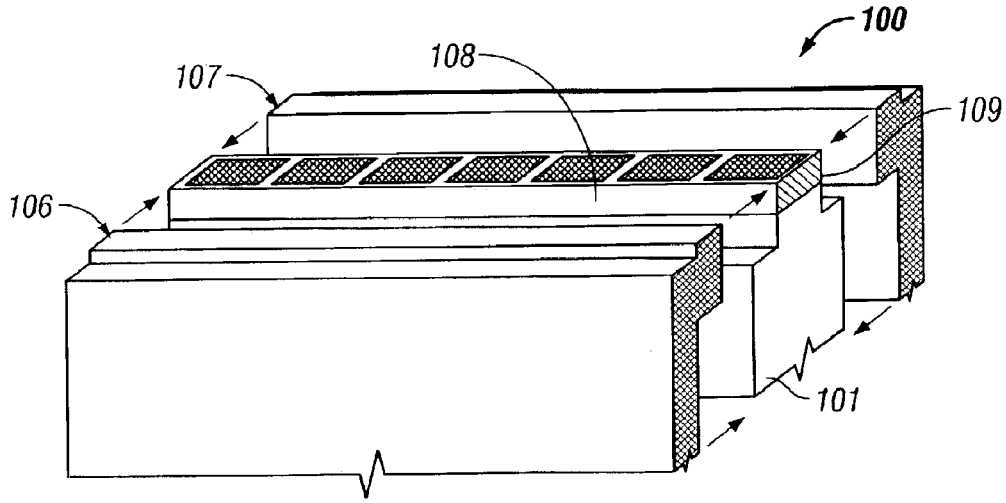
FIG. 3 is an exploded isometric view of the lapping fixture of FIG. 1 and is shown at a subsequent stage of assembly after that of FIG. 1.
Figure 4:
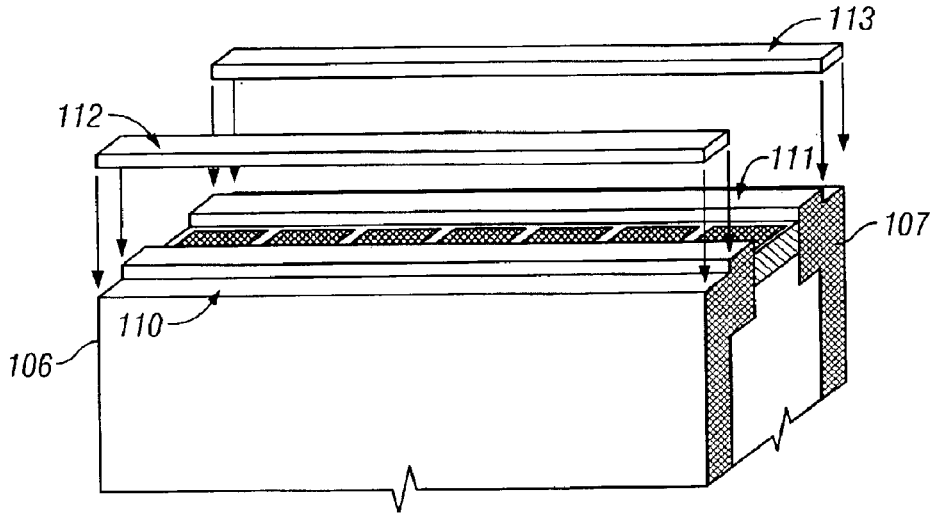
FIG. 4 is an exploded isometric view of the lapping fixture of FIG. 1 and is shown at a subsequent stage of assembly after that of FIG. 3.
Figure 5:
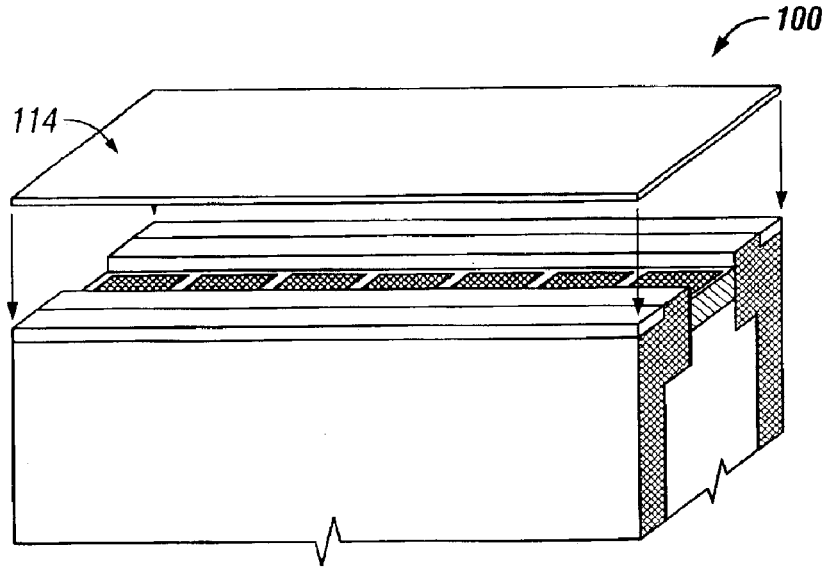
FIG. 5 is an exploded isometric view of the lapping fixture of FIG. 1 and is shown at a subsequent stage of assembly after that of FIG. 4.

Referring now to FIG. 3, a pair of side supports 106, 107 are attached to lapping fixture 100 and serve several purposes, one of which is to add side wall strength to fixture 103 at surfaces 108, 109 so that the air pressure in ports 102 is directed to the membranes 104. Another purpose for side supports 106, 107 is to provide for the mounting of a double-sided adhesive tape 112, 113 (FIG. 4) that is used for mounting a second but single-sided flexible tape platform 114 (FIG. 5). Ultimately, tape platform 114 will support and tangentially restrain a workpiece, which is described below. A pair of steps 110, 111 are formed in side supports 106, 107 to mount double-sided adhesive tape strips 112, 113. Onto these double-sided adhesive tape strips 112, 113 is fastened the single-sided adhesive tape 114 with its adhesive side up, as illustrated in FIG. 5. The thickness of steps 110, 111 is the same as the thickness of the double-sided tape strips 112, 113 so that the single-sided tape 114 is planar when joined to the assembly of lapping fixture 100.

Figure 6:
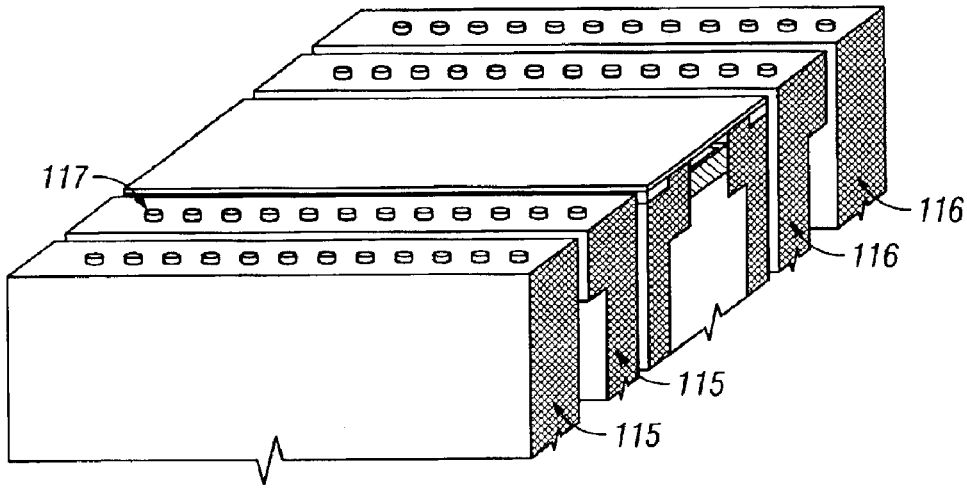
FIG. 6 is an isometric view of the lapping fixture of FIG. 1 and is shown at a subsequent stage of assembly after that of FIG. 5.
Figure 7:
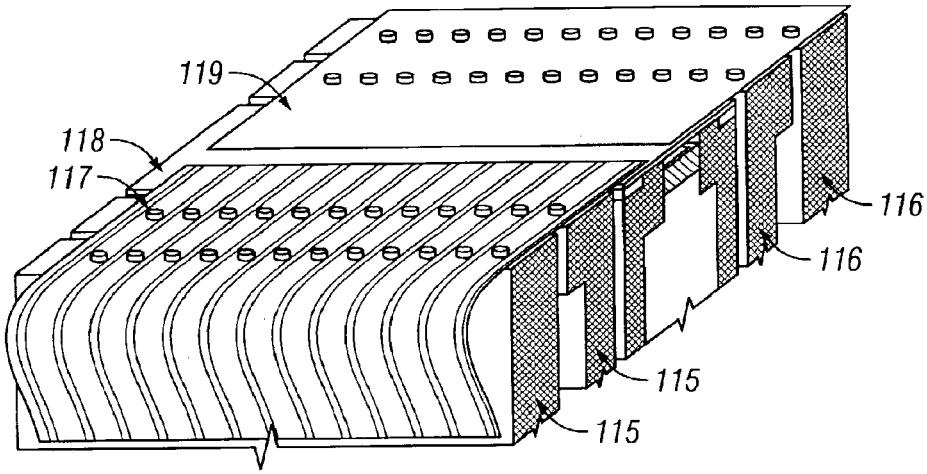
FIG. 7 is an isometric view of the lapping fixture of FIG. 1 and is shown at a subsequent stage of assembly after that of FIG. 6.
Figure 8A:
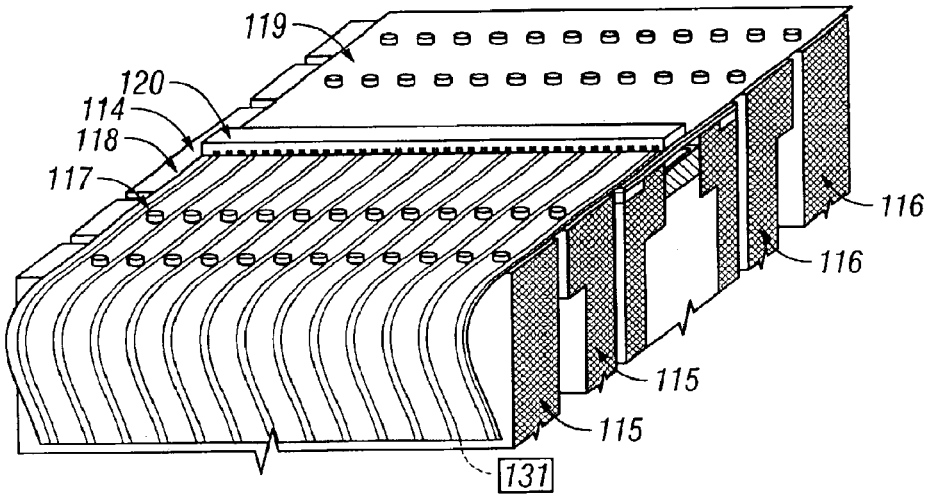
FIG. 8*a* is an isometric view of the lapping fixture of FIG. 1 and is shown during an operational stage with a workpiece.
Figure 8B:
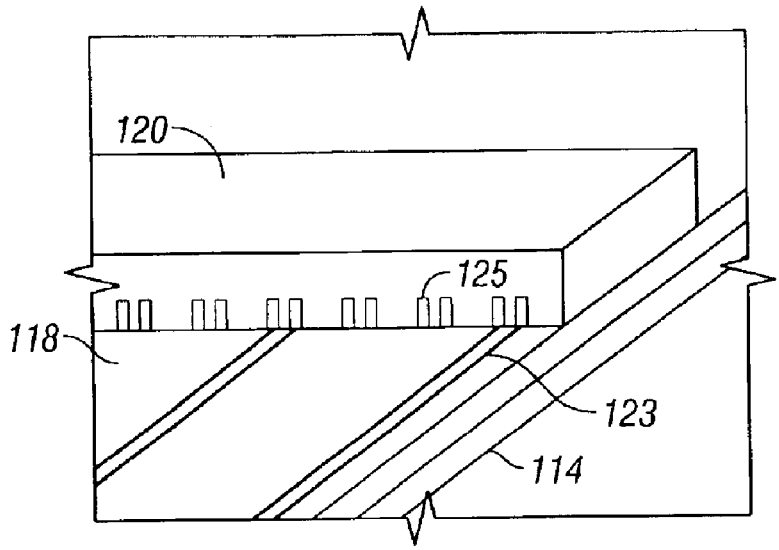
FIG. 8*b* is an enlarged isometric view of a portion of the lapping fixture and workpiece of FIG. 8*a*.

Also mounted onto the lapping fixture 100 are two cantilevered spring assemblies 115, 116 (FIG. 6), each of which have a plurality of mounting pins 117. Spring assemblies 115, 116 are pneumatically actuated and used for mounting a horizontal, flexible, ultra-thin probe cable 118 (FIG. 7), and a similar looking flexible passive cable 119, respectively. The probe cable 118 and passive cable 119 are mounted onto mounting surfaces of the spring assemblies 115, 116 by forcing the cables 118, 119 over the mounting pins 117. The cables 118, 119 are so thin that they are essentially transparent and allow their internal traces or leads to be viewed from their exteriors.

Referring now to FIGS. 8–14, a workpiece 120 (such as a row bar) is mounted onto lapping fixture 100 . A row bar of recording heads typically comprises a series of recording heads arrayed in a linear repeating pattern such that the air bearing surfaces are all on one side. The electrical contacts 123 of workpiece 120 are horizontally aligned with the probe tips 125 (FIG. 8*b*) of probe cable 118 by means of optical alignment to the MR probe pads, ELG probe pads, or the like of the workpiece 120. The workpiece 120 is then lowered in the vertical direction onto the adhesive tape platform 114 and attached by adhesion.

Figure 9:
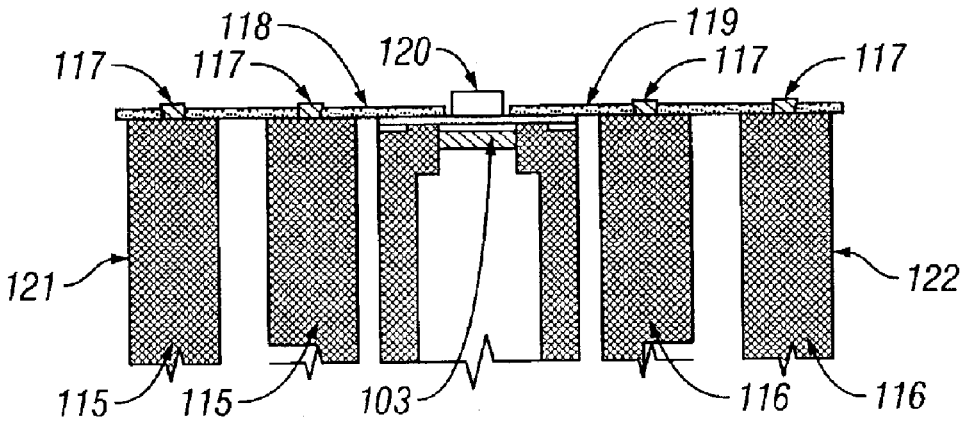
FIG. 9 is a sectional side view of the lapping fixture and workpiece of FIG. 8*a*.
Figure 10:
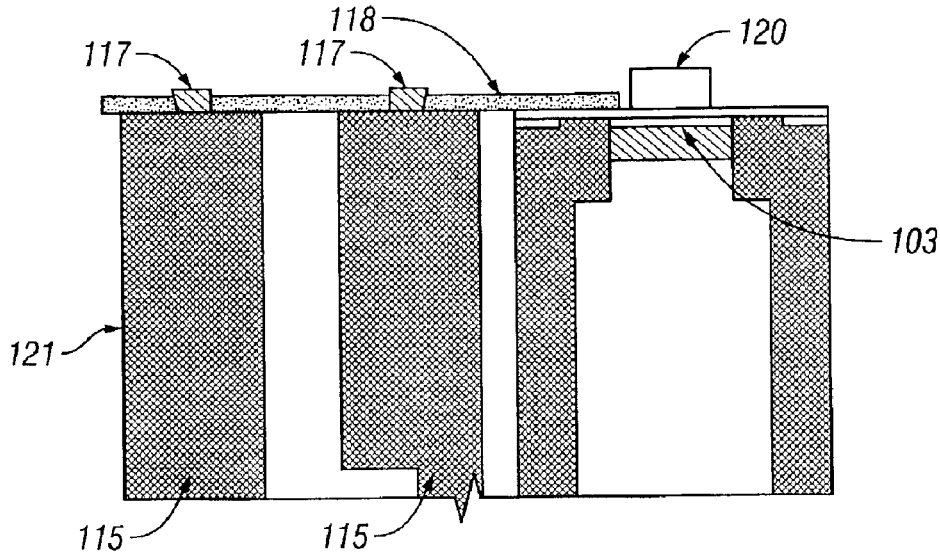
FIG. 10 is a sectional side view of a portion of the lapping fixture and workpiece of FIG. 8*a*.
Figure 11:
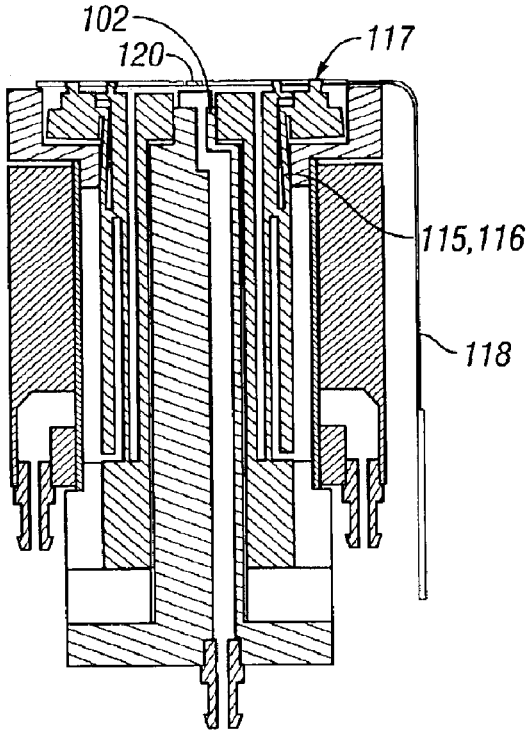
FIG. 11 is a sectional side view of the lapping fixture and workpiece of FIG. 8*a* showing additional components of the lapping fixture.
Figure 12:
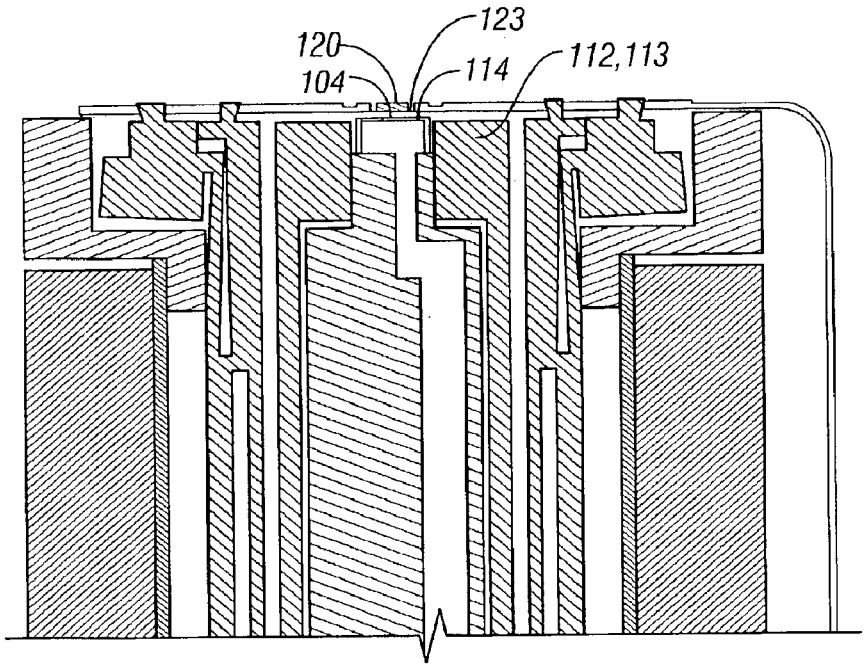
FIG. 12 is an enlarged sectional side view of the lapping fixture and workpiece of FIG. 11.

At the onset of lapping, it is necessary to collect initial resistance data from MR devices, ELG devices, or other types of feedback devices using the probe cable system described above, which is connected to a data acquisition system, which is indicated schematically at 131. The forces required to make probe contact will distort the workpiece 120 during lapping, thus causing extreme air bearing flatness problems. It is therefore necessary to stop lapping and probe periodically. FIG. 9 shows active probe cable 118 and passive cable 119 out of contact with the workpiece 120. By activating mechanical forces at 121, 122, the active cable 118 and passive cable 119 come into contact with the workpiece 120. Once data is collected the active and passive cables 118, 119 are retracted.

Figure 13:
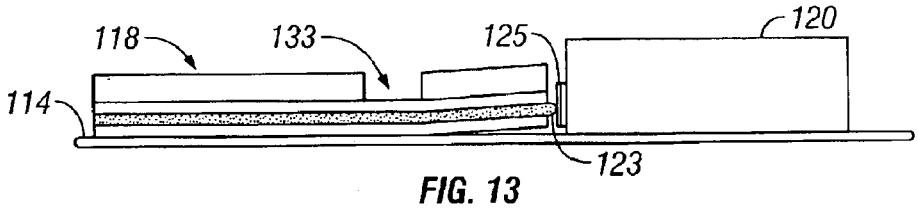
FIG. 13 is an enlarged sectional side view of a probe cable and the workpiece of FIG. 11.
Figure 14:
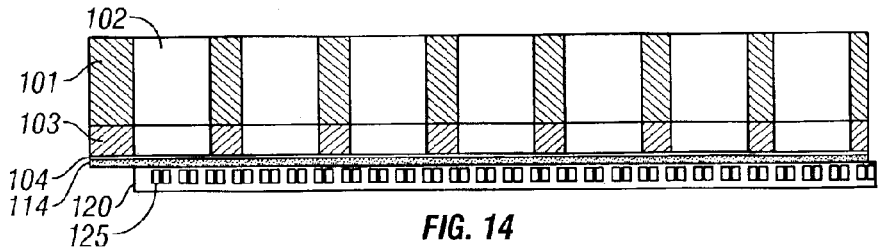
FIG. 14 is a partially-sectioned end view of contact between the lapping fixture and workpiece of FIG. 11.

The mechanics for loading and unloading the cables 118, 119 is difficult in the space dictated by IDEMA slider sizes known as pico and femto sliders. In addition, the ability for approximately 88 or so cable probe tips 123 to come into contact with approximately 88 row bar probe pads 125 is difficult. The row bar probe pads 125 are not necessarily perfectly straight and the row of probe tips 123 is not necessarily perfectly straight. Note that the mounting pins 117 are tapered on one side, thereby allowing the probe cable 118 to deform and be forced over the mounting pins 117. The ultra-thin probe cable 118 and short pins 117 better accommodate the small operating height of the row bar workpiece 120. In one embodiment, the probe cable 118 is a multi-layer cable having laser splits for each pair of beryllium copper leads with gold tips over-plated to protrude so they can operate independently of each other. The probe cable 118 also may comprise a multi-layer cable with a relief cut 133 (FIG. 13). The relief cut 133 allows the probe tips 123 to bend away from adhesive layer 114 to accommodate any errors in straightness or alignment of either the row bar workpiece 120 or the cable tips 123 themselves.

In one embodiment of the present invention, this single row kiss lap process is designed to be a finishing step in preparing the final quality of the air surface of the workpiece 120 in terms of all requirements such as flatness, recession, and any other performance related requirements. Under such conditions, there is a less precise lapping or grinding process prior to this operation, such as bow compensation lapping (BCL), that would deliver a fair quality row bar such that this final lapping operation removes a very small amount of material to achieve a very high quality final product. Such processing significantly reduces the time and plate wear in this delicate process. However, BCL is unable to lap the stripe height to the desired tight range of stripe height. Moreover, the holding device for BCL causes distortion to the workpiece, which results in unacceptable flatness parametrics.

As stated previously, at the onset of lapping it is necessary to collect initial resistance data by means of a computer, amplifier controller, or field coils to measure MR devices, ELG devices, or the like, via a probe cable system, all of which is in a closed-loop periodic feedback system that works in conjunction with a pneumatically-controlled lapping system. Initial data is collected and by means of typical calibration of such devices, a determination of the initial performance of the row bar workpiece 120 is made, which is typically referred to in terms of MR stripe height, ELG stripe height related to MR stripe height, MR resistance, MR amplitude, and other performance related values and combinations thereof.

By further evaluation of the performance data, the first lapping end point distances are calculated along with the first mechanical settings. These settings relate to air cell 102 settings of pneumatic pressures that will apply to localized lapping forces across the row bar workpiece 120 to begin to remove the differences between each performance device, thereby attempting to bring them to the performance value.

Figure 15:
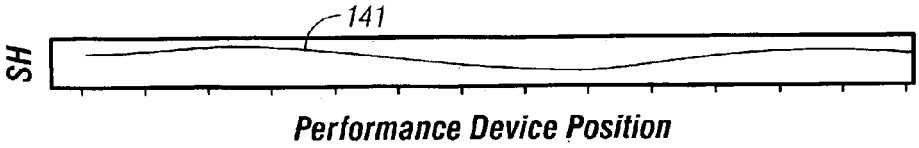
FIG. 15 is a plot illustrating, along the vertical axis, an initial stripe height of a workpiece with respect to a length of the workpiece along the horizontal axis.
Figure 16:
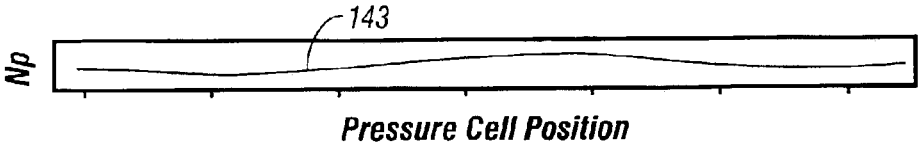
FIG. 16 is a plot illustrating, along the vertical axis, an initial force profile for the lapping fixture of the present invention with respect to the workpiece of FIG. 15, with respect to the length of the workpiece along the horizontal axis.

Referring now to FIGS. 15 and 16, an illustrative example for adjusting one operational criteria for the present invention is shown. In this example, stripe height is the performance parameter that is being monitored by the lapping fixture 100. A row workpiece 120 produces a stripe height profile 141 by slider position as shown in the plot of FIG. 15. The algorithm of the present invention engages cables 118, 119 with the workpiece 120 to make electrical resistance measurements along the length of the workpiece 120. The algorithm then calculates the lapping force required to reduce variation in stripe height, which is typically proportional to the inverse of the lapping stripe height profile 141. The air cell pressure assignments for each pressure cell 102 (FIG. 1) are shown by the plot of force (Np) profile 143 in FIG. 16. The algorithm then retracts cables 118, 119 and begins lapping the workpiece 120 until the first lapping period is complete and the lapping machine is stopped. The algorithm then reactivates the cables 118, 119 and new measurement data is collected. The algorithm repeats these steps as needed to reach the desired goal or tolerance. The resulting adjustments in cell pressures cause the stripe height to be more uniform with each pass. Likewise, if the stripe height is ever less uniform than it was in a previous iteration, the algorithm adjusts cell pressures accordingly for the next lapping sequence. This process is repeated until the average final stripe height value reaches the target value.

Figure 17:
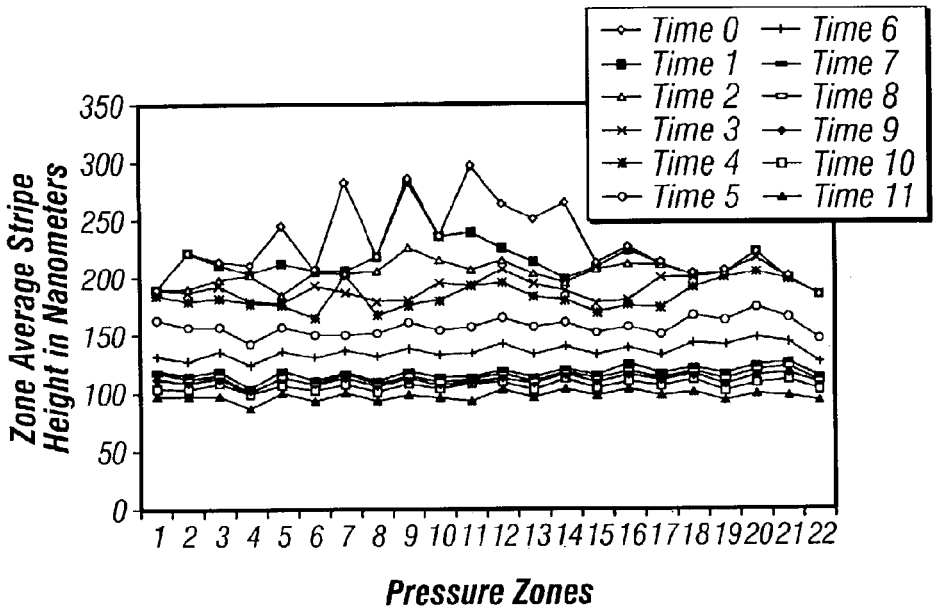
FIG. 17 comprises plots of lapping progression on a workpiece during discrete sampling events with the lapping fixture of the present invention.

What has been described is a mechanical tool, feedback system, and algorithm used to lap, for example, the air bearing surface of a contiguous row of magnetic recording heads. Electrical resistance is measured on a periodic basis and used to adjust the lapping force across the row so that performance values, such as stripe height, can first be made substantially uniform across the row and end lapping at a final average target. FIG. 17 is provided as an empirical example to demonstrate actual plots of performance data. In this case, the stripe height starts with the initial data collection at "Time 0," the row is lapped and reduced in stripe height. Subsequent collections of stripe height data are taken and lapping is performed until the stripe height target of 100.0 nm (e.g., "Time 11") is reached and lapping is terminated.

In summary, the following steps occur during the method of the present invention. First, the electrical resistance of each read sensor on the workpiece is measured and a stripe height profile is calculated. Next, a desired applied pressure is calculated for each read sensor using an appropriate function, which is roughly proportional to the amount of material removal desired. The workpiece is then lapped for a programmed time such that the amount of material removed is below the target by some amount. These three steps are then repeated to close in on the target (e.g., stripe height) through an iterative process until the workpiece is within an acceptable range.

Figure 18:
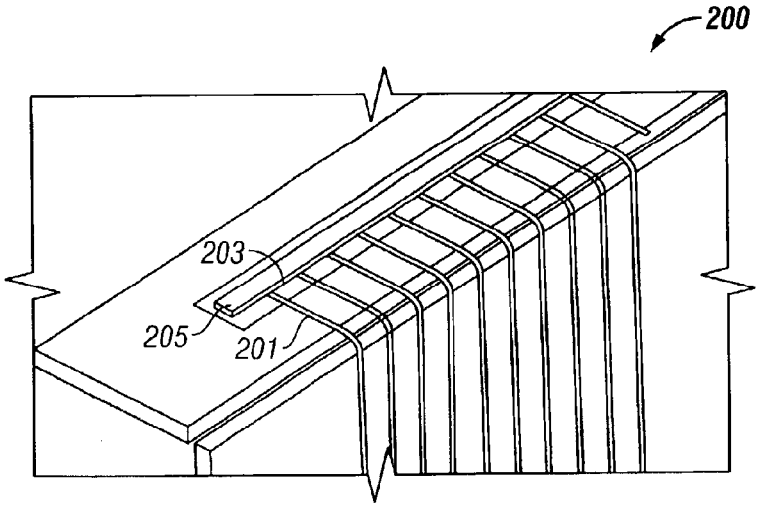
FIG. 18 is an isometric view of an alternate embodiment of the present invention comprising a rigid card probe assembly constructed in accordance with the present invention.
Figure 19:
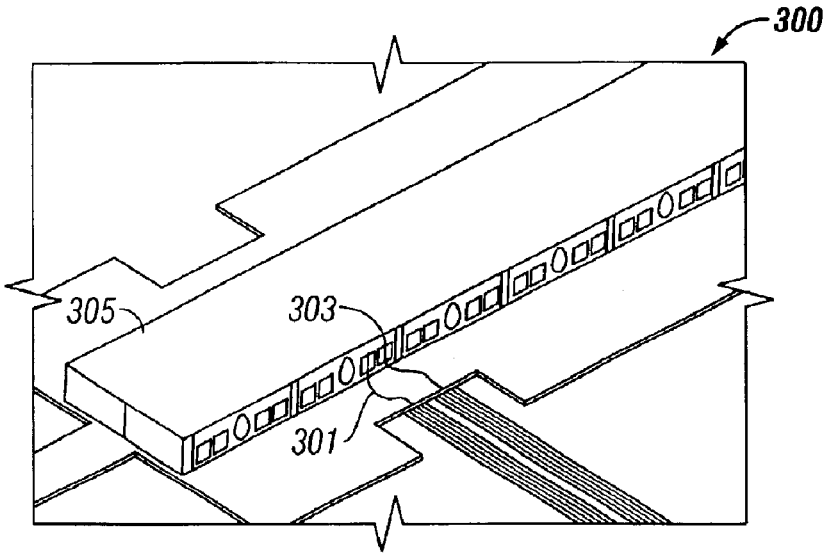
FIG. 19 is an isometric view of another alternate embodiment of the present invention comprising an ultrasonic attachment assembly constructed in accordance with the present invention.

Two alternate embodiments of the present invention are depicted in FIGS. 18 and 19. Unlike the previous embodiment which employs a "sampled resistance" (i.e., non-continuous) method to determine the condition of the workpiece, each of the two alternate embodiments uses an "in-situation" feedback method that maintains continuous electrical contact to assess the compliance of the workpiece. In other words, the resistance of the workpiece can be measured at any time, including while the lapping is occurring, such that electrical contact with the workpiece is continuous and uninterrupted. The control algorithm for this method may comprise methods of control such as PID (proportional, integral, derivative), PI (proportional, integral), or still other control algorithms. The method ends in the same manner as the first embodiment when the target parameter is achieved (e.g., target stripe height or resistance is reached).

For example, in FIG. 18, a lapping fixture 200 comprises a rigid card array of probes 201 that extend into direct, uninterrupted contact with the electrical contact pads 203 on row workpiece 205. In FIG. 19, a lapping fixture 300 comprises fine wires 301 which are ultrasonically attached to the pads 303 on workpiece 305. Other than the elements used to contact the respective workpieces and the continuous measurements being taken, the lapping fixtures of these two in-situation embodiments operate in substantially the same manner as the previous sampled resistance embodiment. In yet another alternate embodiment, the clamping system of the first embodiment may be used to perform in-situation resistance measurements as well. However, for the in-situation embodiments of the present invention, it is more difficult to obtain accurate electrical resistance readings due to the physical limitations imposed due to lapping. The workpiece must be held and restrained without distortion, it must be held during lapping, it must be held during electrical resistance probing, and the restraint must be accomplished in very limited space.

Figure 20:
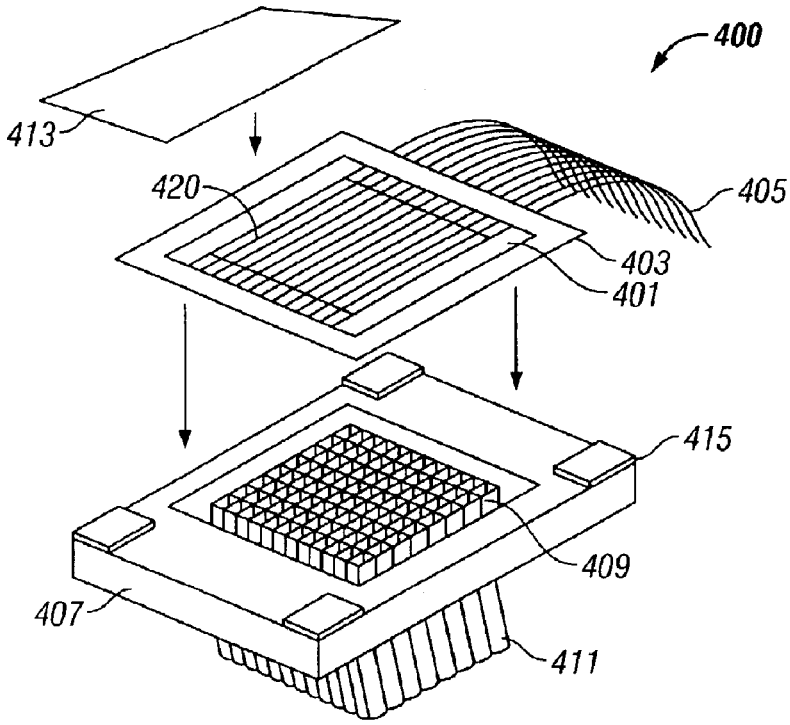
FIG. 20 is an isometric view of yet another alternate embodiment of the present invention comprising a multi-chamber lapping system constructed in accordance with the present invention.

Referring now to FIG. 20, still another alternate embodiment of the present invention is shown as a lapping process fixture 400. Fixture 400 is designed to simultaneously support and process a plurality of discrete workpieces 420, rather than a single workpiece. Although fixture 400 is shown supporting twelve row workpieces 420 of magnetic read/write head stock, each having a plurality of air bearing surfaces (ABS) thereon, more or fewer rows may be supported by fixture 400, as well as other types and sizes of workpieces. In addition, fixture 400 may be adapted for use with different types of processing techniques other than lapping. Fixture 400 may employ any of the previously described techniques or methods to accomplish the same objectives as the earlier embodiments.

In the version shown, the workpieces 420 are located on a thin flexible sheet or membrane 401, such as dicing tape, that is mounted to a planar frame 403. In one version, membrane 401 is coated with adhesive, such that workpieces 420 adhere to its surface. A feedback cable 405 extends from frame 403 and is electrically interconnected to workpieces 420, either in a sampled or in-situation configuration, as described above for the previous embodiments. Frame 403 and membrane 401 are joined to a base 407 having a large plurality of individually-actuated pressure ports 409. Each port 409 is interconnected to its own pressure connection 411, which provides precise power and control for the discrete ports 409. A fluid, such as a gas or liquid, is used to provide the membrane 401 with a highly manipulable, resilient outer surface for adjustably supporting the workpieces 420. Like the previous embodiments, the ports 409 are pressurized via an external pressure source, such as a pump, which delivers the fluid.

In operation, the fixture 400 is used in the same manner as the previous embodiments while reducing distortion of their ABS due to restraining or holding forces. The membrane 401 supports the workpieces 420 while they are processed with a lapping device 413. Since the workpieces 420 are located completely within the area defined by the array of ports 409, the workpieces 420 are fully supported by membrane 401 and are substantially restrained from movement in a direction normal to membrane 401 by the pressure of the fluid. The thin membrane 401 itself bends elastically very easily due to its low bending moment of inertia. Because membrane 401 has very low stiffness to bending, distortion of workpieces 420 in the normal direction is low. Moreover, since the normal-directed support is provided by fluid pressure in the individual ports 409, the pressure and support profile along each of the workpieces 420 can be individually tailored.

In addition, the adhesive coating on membrane 401 substantially restrains the workpieces 420 from movement in a direction that is tangential to membrane 401. The adhesive on membrane 401 provides the tangential force needed to drag the ABS along the lap plate 413. This allows workpieces 420 to be lapped against lap plate 413 such that their ABS will conform to the shape of lapping surface. Membrane 401 provides excellent transfer of tangential force because the tangential force is in the tension axis of the material of membrane 401. Fixture 400 is also provided with a plurality of wear pads 415 which assist in providing a fixed spacing between the lapping plate 413 and fixture 400. During the lapping procedure, fixture 400 rests against plate 413 via wear pads 415. Thus, both the ABS of workpieces 420 and wear pads 415 are abraded simultaneously. The fixed spacing provided by wear pads 415 will slowly decrease with wear.

The present invention has several advantages including the ability to restrain a workpiece in such a manner that minimizes the restraining forces exerted on the workpiece, thereby minimizing distortion of the workpiece during lapping processes. The highly compliant fixture allows the ABS to be more uniformly, quickly, and accurately lapped to conform to the shape of the lapping surface. Assuming negligible force is need to deflect the membrane in the normal direction of the supporting membrane, the fluid will cause the membrane to conform to the curvature of the head/row at the adhesive attachment region and, hence, minimize distortion of the workpiece. This will allow tighter control of curvature in ABS for the lapping process.

The present invention provides a means for ABS lapping a plurality of magnetic recording heads such as magneto resistive (MR) heads along a wafer substrate section (e.g., a row bar). The air cell holding method that does not distort the row bar during lapping and, thus, prevents lapped-in distortion known as twist crown and camber. The air cell suspension method of the present invention applies individual air pressures to each cell for the purpose of adjusting lapping loads along the length of the row bar and thereby adjusts the lapping rate along the length of the row bar. The ultra thin horizontal probing cable probes MR devices or electrical lapping guides (ELGs) for the purpose of acquiring feed back signals that can be used for controlling the lapping process. The computer controlled servo system continually reads signals for MR or ELG devices via the probing cable, determines critical performance heights such as MR stripe height, and continually readjusts air cell pressures to end lapping process on exacting performance height requirements.

While the invention has been shown or described in only some of its forms, it should be apparent to those skilled in the art that it is not so limited, but is susceptible to various changes without departing from the scope of the invention.

What is claimed is:

1. An apparatus for processing a workpiece, comprising:

a base having a plurality of ports extending therethrough and a plurality of flexible membranes, each of the ports being sealed on one end with a respective one of the flexible membranes, and each of the ports being independently pressurized for selectively expanding and retracting the flexible membranes;

a flexible platform mounted to the base such that the plurality of flexible membranes are covered by the flexible platform, the flexible platform being adapted to support the workpiece such that the workpiece is aligned with the plurality of flexible membranes, and pressure in the ports substantially restrains the workpiece from movement in a direction normal to the workpiece; and an electrical circuit mounted to the base and adapted to be electrically interconnected with the workpiece when the workpiece is mounted to the flexible platform, such that a physical characteristic of the workpiece is ascertained by the electrical circuit to selectively adjust a pressure in each one of the ports and thereby manipulate and differentiate respective ones of the flexible membranes to process the workpiece with respect to the physical characteristic.

2. The apparatus of claim 1, wherein the electrical circuit comprises a probe cable having a set of electrical probes and movably mounted to the base between an engaged position for electrically engaging the workpiece with the electrical probes, and a disengaged position for electrically disengaging the workpiece with the electrical probes.

3. The apparatus of claim 1, further comprising a damp mounted to the base for selectively clamping the workpiece to enable electrical interconnection with the workpiece.

4. The apparatus of claim 1 wherein the electrical circuit comprises a rigid card array of probes that maintain continuous electrical interconnection with the workpiece.

5. The apparatus of claim 1 wherein the electrical circuit comprises wires that are ultrasonically attached to the workpiece to maintain continuous electrical interconnection therewith.

6. The apparatus of claim 1 wherein the base has an array of the ports and the flexible membranes are configured to align with a plurality of workpieces, the array of ports and the flexible membranes being independently pressurized to simultaneously process all of the workpieces with regard to their respective physical characteristics.

7. The apparatus of claim 1, further comprising an adhesive on the flexible platform for substantially restraining the workpiece from movement in a direction tangential to the flexible platform strictly via adhesive bonding with a tangential force in a tension axis of the flexible platform.

8. A system for processing a workpiece having a length, a plurality of electrical contacts extending along the length, and a physical characteristic that varies along the length, the system comprising:

a base having a plurality of ports extending therethrough and a plurality of flexible membranes, each of the ports being sealed on one end with a respective one of the flexible membranes to form an array, and each of the ports being independently pressurized for selectively expanding and retracting the flexible membranes;

a flexible platform having an adhesive surface and mounted to the base such that the plurality of flexible membranes are covered by the flexible platform, and the flexible platform supports and restrains the workpiece with the adhesive surface in a direction tangential to the flexible platform so that the length of the workpiece is aligned with the array of flexible membranes, and pressure in the ports substantially restrains the workpiece from movement in a direction normal to the flexible platform;

a probe cable having a set of electrical probes and movably mounted to the base between an engaged position for electrically engaging the electrical contacts with the electrical probes, and a disengaged position for electrically disengaging the electrical contacts with the electrical probes;

a passive cable movably mounted to the base between an engaged position for physically engaging the workpiece opposite the electrical probes, and a disengaged position for disengaging the workpiece;

a set of cantilever springs mounted to the base for selectively moving the probe cable and the passive cable between the engaged positions so that the workpiece is clamped between the probe cable and the passive cable, and the disengaged positions so that the workpiece is out of contact with the probe cable and the passive cable; and a controller for controlling the pressures in the ports, the probe cable, the passive cable and the set of cantilever springs, such that the physical characteristic of the workpiece is ascertained by electrically to selectively adjust a pressure in each one of the ports and thereby manipulate and differentiate respective ones of the flexible membranes along the length of the workpiece to process the workpiece with respect to the physical characteristic.

9. The system of claim 8, wherein the flexible platform is secured to the base with a set of double-sided adhesive strips that are located on opposite sides of the workpiece, and the flexible membranes form a single row between the double-side adhesive strips.

10. The system of claim 8, wherein the probe and passive cables are secured to the cantilever springs with mounting pins which extend through the probe and passive cables at a height which is less than a height of the workpiece.

11. The system of claim 8, wherein the cantilever springs are pneumatically actuated to move between the engaged and disengaged positions.

12. The system of claim 8, wherein the probe cable has a relief cut that allows the electrical probes to bend away from the flexible platform to accommodate any errors in straightness or alignment of the workpiece or the probe cable.

13. A method of processing a workpiece, comprising:

(a) mounting a workpiece to a fixture such that the workpiece aligns with an array of pressure port located in the fixture, each of the pressure ports being sealed with a flexible membrane;

(b) electrically interconnecting with the workpiece to measure a physical characteristic of the workpiece that varies along the workpiece;

(c) selectively adjusting a pressure in each one of the pressure ports in response to step (b) and thereby expand and contract respective ones of the flexible membranes to accommodate the workpiece;

(d) processing the workpiece with respect to the physical characteristic; and (e) repeating steps (b) through (d) until the physical characteristic of the workpiece is in compliance.

14. The method of claim 13, wherein step (a) comprises adhesively bonding the workpiece to the fixture.

15. The method of claim 13, wherein step (b) comprises establishing continuous electrical interconnection with the workpiece during steps (c) and (d).

16. The method of claim 13, wherein step (b) comprises discontinuing electrical interconnection with the workpiece during step (d).

17. The method of claim 13, wherein step (b) comprises clamping the workpiece.

* * * * *

UNITED STATES PATENT AND TRADEMARK OFFICE

CERTIFICATE OF CORRECTION

PATENT NO. : 6,846,222 B2
DATED : January 25, 2005
INVENTOR(S) : Church et al.

It is certified that error appears in the above-identified patent and that said Letters Patent is hereby corrected as shown below:

Column 9,
Line 13, please replace the word “damp” between the words “a” and “mounted” with the word -- clamp --.

Signed and Sealed this

Twenty-sixth Day of April, 2005

JON W. DUDAS
*Director of the United States Patent and Trademark Office*